United States Patent [19]

Garner

[11] 4,252,584

[45] Feb. 24, 1981

[54] METHODS AND APPARATUS FOR WRAPPING ARTICLES OF INDEFINITE LENGTHS

[75] Inventor: John N. Garner, Point Claire, Canada

[73] Assignee: Northern Telecom Limited, Montreal, Canada

[21] Appl. No.: 78,170

[22] Filed: Sep. 24, 1979

[51] Int. Cl.[3] ..... H01B 13/06

[52] U.S. Cl. ..... 156/54; 156/201; 156/461; 156/463

[58] Field of Search ..... 156/51-56, 156/200, 201, 202, 195, 185, 203, 466, 463; 174/116, 120 R, 121 R, 122 R, 124 R; 93/82

[56] References Cited

U.S. PATENT DOCUMENTS

| | | | |
|---|---|---|---|
| 2,133,620 | 10/1938 | Isenberg | 156/466 X |
| 2,200,933 | 5/1940 | Nystrom et al. | 93/82 |
| 2,494,050 | 1/1950 | Loucks | 156/54 |
| 2,936,257 | 5/1960 | Nailler et al. | 156/52 X |
| 3,337,386 | 8/1967 | Burr | 156/54 X |
| 3,340,113 | 9/1967 | Burr | 156/54 |
| 3,617,421 | 11/1971 | Gray et al. | 156/56 X |

FOREIGN PATENT DOCUMENTS

| | | | |
|---|---|---|---|
| 137934 | 2/1934 | Australia | 156/201 |
| 1852778 | of 1853 | United Kingdom | 156/52 |
| 602999 | 5/1976 | U.S.S.R. | 156/53 |

*Primary Examiner*—David A. Simmons

[57] ABSTRACT

The wrapping of articles of indefinite length, particularly cable by locating wrapping material along and parallel to a facing surface of the article and wrapping the material around the article while substantially avoiding frictional contact between material and article. With the wrapping material loosely applied, binding material is applied to cause the wrapping material to tightly surround the article. A forming die for performing the operation, has an arcuate orifice extension connected to the die orifice for guiding an overlapping edge of wrapping material. Apparatus is included which has at least one die. Where more than one die is used, the positional relationship of the dies is determined to prevent the frictional contact between material and article during wrapping.

6 Claims, 8 Drawing Figures

METHODS AND APPARATUS FOR WRAPPING ARTICLES OF INDEFINITE LENGTHS

This invention relates to methods and apparatus for wrapping articles of indefinite length.

In the wrapping of articles of indefinite length, such as, for instance electric or telecommunications cable core, difficulties have been experienced in avoiding wrinkles or kinks in the finished wrapping. In the case of wrapping articles of indefinite length by passing the articles progressively along a feed path so as to wrap progressively along their length, this has aggravated the tendency to form wrinkles or kinks.

Further, the methods commonly used to wrap cable are restrictive upon the speed of a whole cable forming, wrapping and insulation process.

The present invention provides a method of wrapping an article of indefinite length with wrapping material which at least reduces the tendency for wrinkles to occur and which may be operated at higher speeds that has heretobefore been possible with conventional wrapping methods.

According to one aspect of the present invention there is provided a method of wrapping an article of indefinite length comprising disposing the wrapping material lengthwise along and parallel to a facing part of the article, wrapping the wrapping material around the article while passing one edge over another to produce a portion of material overlapping another portion, the wrapping being sufficiently slack to substantially prevent frictional contact between material and article so as to allow for relative circumferential movement between them, and then securing the wrapping material to the article by applying a binding material around the wrapping material progressively along the length of the article, the binding material causing the wrapping material to tightly surround the article by relative movement of the overlapping and overlapped portions further into overlapping relationship.

The slackness between the wrapping material and the article prevents the wrapping material from being held locally by the article during wrapping and during application of the binding material whereby the wrapping material is allowed freedom to move. In this way, any frictional contact is avoided for as long as possible between article and wrapping material and only occurs when the wrapping material assumes its position tightly upon the cable.

According to another aspect of the invention, wrapping material is disposed lengthwise along a side of the article while substantially preventing frictional contact between material and article, the material also having opposite edges extending lengthwise of the article, and the material is wrapped around the article progressively along the length of the article while passing one edge of the material over the other and while keeping the overlapping and overlapped portions spaced apart and while still preventing frictional contact between material and article, the overlapping and overlapped portions being maintained spaced apart as wrapping proceeds. These portions are allowed to contact each other towards the end of the wrapping process at which point the wrapping is still sufficiently slack to prevent significant frictional contact between material and article. Binding material is then applied to tighten the wrapping material onto the article.

According to yet another aspect of the invention, a forming die is provided for wrapping an article. The die has a forming die orifice and an arcuate tongue extending angularly partly around the orifice, the tongue having a free end to define an arcuate die orifice extension radially outwardly of the tongue, the extension being interconnected to the die orifice adjacent the tongue.

The inventive method and forming die are useful for wrapping an electric or telecommunications cable core in wrapping material which may be in the form of aluminum or other materials such as plastic wrapping materials normally used, e.g. polypropylene.

The invention also includes apparatus for wrapping an article of indefinite length comprising positioning means for positioning the article and the wrapping material on a feedpath with the wrapping material disposed along one side of the article in one position on the feedpath, means for moving the article and material together along the path, and at least one forming die as defined above disposed along the path and downstream of said one position.

Embodiments of the invention will now be described by way of example, with reference to the accompanying drawings in which.

Figure 1:
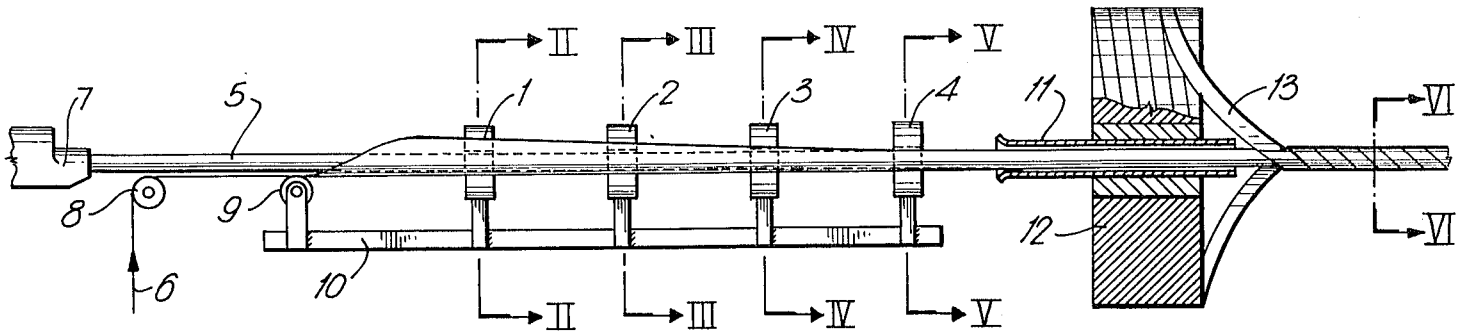
FIG. 1 is a side elevational view of apparatus according to a first embodiment for wrapping telecommunications cable core.

According to a first embodiment, as shown in FIG 1, apparatus for wrapping telecommunications cable core comprises four in-line forming dies 1, 2 and 3 and closing die 4 spaced apart along a feedpath for electric cable core 5 and wrapping material 6. The cable core is positioned on the feedpath through the dies by a powder core filling device 7 for the core in a case where it is a multiconductor core.

The wrapping material 6, which may be aluminum paper or plastic strip, is in indefinite length and is fed from a coil of the material (not shown) around a roller 8 to an entrance roller 9 to the first die 1. An important feature of the apparatus which enables the inventive method to be followed is that the uppermost part of the periphery of entrance roller 9 is horizontally aligned with the lowermost parts of inner peripheral surfaces of the dies forming die bores and that the feedpath is also horizontal through the dies.

To maintain this horizontal positioning of these peripheral surface parts, the dies and the entrance roller are all horizontally slidably mounted upon a rigidly fixed slide bar 10.

Downstream of the forming dies is located a tube 11 in axial alignment with the dies for passage therethrough of the cable core enwrapped in the wrapping material and to feed it axially through a rotatable binder head 12 which feeds a binding material 13 onto the enwrapped core.

The forming die 1 (FIG. 2) defines a die orifice 14 formed by inner peripheral surface 15. An integrally formed arcuate tongue 16 of the die extends angularly partly around the orifice to define, radially outwards of the tongue, an arcuate die orifice extension 17 which is interconnected with the die orifice at a free end 18 of the lip.

Apart from the extension 17 and the radially outward movement of the peripheral surface 15 to help form the extension, the bore 14 is substantially circular. It is not essential for the bore to be circular. It could be oval, or elliptical or have a surface for instance of involute shape. As may be seen from FIG. 2, the bore 14 is substantially larger in diameter than the size of the cable core 5.

Figure 4:
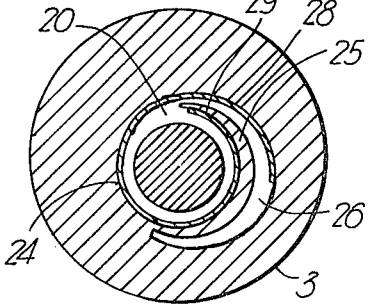
Figure 3:
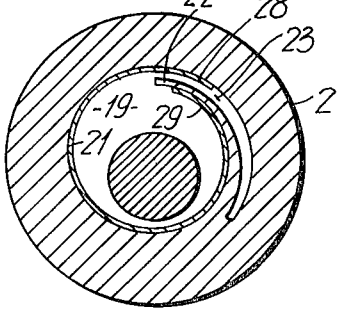

The other forming dies 2 and 3 are of substantially the same configuration as die 1 except that the bore size decreases from bore 14 to bore 19 in die 2 (FIG. 3) and then to bore 20 in die 3 (FIG. 4). The bore 19 is defined by inner peripheral surface 21 of die 2, and this die has an arcuate tongue 22 defining an arcuate die orifice extension 23 interconnected with the bore 19. Likewise, the die 3 has its bore 20 formed by inner peripheral surface 24 and has arcuate tongue 25 and arcuate die extension 26.

Figure 5:
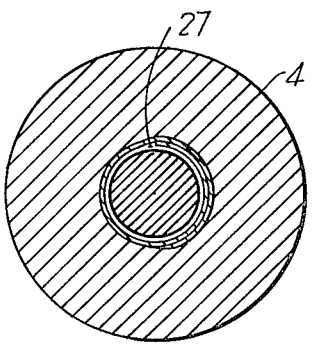
FIGS. 3, 4 and 5 are views similar to FIG. 2 of other forming dies taken, respectively along lines III—III, IV—IV and V—V in FIG. 1.

FIG. 5 shows the closing die 4 which is of conventional shape and has a normal circular die bore 27 while being devoid of a tongue and die orifice extension.

Means (not shown) is included in the apparatus for moving the cable core and wrapping material together along the pass line. This moving means is of conventional construction and need not be described.

In use of the apparatus, the cable core is fed from a cable filling operation at station 7 along the feed path and through the dies and tube 11 as shown in FIG. 1. The wrapping material 6 is fed around the roller 8 and over roller 9 before reaching die 1. The path of movement of the cable core is slightly above the roller 9 and is thus spaced slightly from the wrapping material which is supported by roller 9 in a substantially flat horizontal condition. The cable core is fed through the dies 1 to 4 while maintaining a distance from the lowermost position of the peripheral surfaces of the die bores substantially equal to its distance above roller 9. This distance is a mean or predetermined distance which is affected to a degree by the tendency for the cable core to vibrate across its feed path during forward movement. As may be seen from FIGS. 2 to 4, the distance of the cable core is maintained substantially equal distances from the lowermost parts of the peripheral surfaces 15, 21 and 24. This distance is also maintained in die bore 27 or die 4 (FIG. 5).

Figure 2:
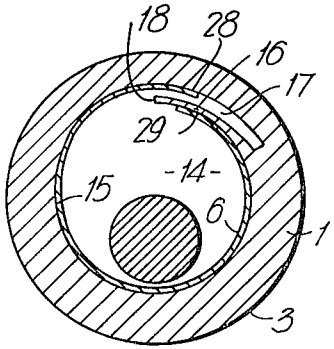
FIG. 2 is a cross-sectional view through the axis of a forming die included in the apparatus, taken along line II in FIG. 1 and showing cable core and wrapping material passing through the die.

The wrapping material is thus maintained at a substantially equal distance from the lower part of the cable core from roller 9 at least to the exit side of closing die 4. As the wrapping material moves forward, it is curled over initially by die 1 and is restrained into arcuate shape as shown in FIG. 2 by sliding axially in contact with the surface 15. One longitudinal edge of the material 6 extends into the arcuate die extension 17 and forms an overlapping portion 28 which overlaps an overlapped portion 29 extending from the opposite edge. The tongue 16 ensures that the portions 28 and 29 remain spaced apart.

Figure 6:
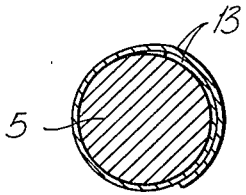
FIG. 6 is a cross-sectional view of wrapped and bound cable core, taken along line VI—VI in FIG. 1.

Thus the overlapping and overlapped portions 28 and 29 are not allowed to contact one another and the holding of the cable core a mean distance above the wrapping material located beneath it ensures that substantially no frictional contact is permitted between core and material 6, although the core may touch the material momentarily during its vibration across the pass line. This state of clearance is maintained through dies 2 and 3 as is seen from FIGS. 3 and 4. These die orifices decrease in diameter from one to another so that the upwardly extending curved portions of the wrapping material draw in closer to core 5 accompanied by the portions 28 and 29 moving into greater degrees of overlapping relationship. As the wrapping material passes into the closing die 4, it is towards the end of its drawing in process and the overlapped and overlapping portions finally come into contact. In this position (FIG. 5), the wrapping material forms a loosely fitting tube around the core and significant frictional contact with the core is still avoided. The wrapped core then passes through tube 11 and then the binding material 13 is wrapped around it. The binding material and its method of application are conventional. The binding material draws the wrapping material in closely onto the core (FIG. 6) by further movement of overlappng and overlapped portions into overlapping relationship. This final inward movement takes place over a very small distance and any frictional contact between core and wrapping material is insufficient to cause wrinkling or kinking of the material. Also the distance of sliding movement between the portions 28 and 29 is sufficiently small as to reduce or minimize any tendency to cause wrinkles.

It is found that the application of this process is successful in producing a wrinkle free wrapped cable core. This is made possible by maintaining the lower portion of the wrapping material parallel to the facing part of the core, i.e. the lowermost part from a position prior to commencement of wrapping until the wrapping material has reached the closing die or beyond. Thus, any frictional contact between core and material is avoided as much as is practical and such contact, if such occurs, is only momentary. Hence, the wrapping material is not restrained at any time during wrapping by the core but is free to allow the die shapes to curl it around the core in wrinkle free manner. As stated, the final movement of the wrapping material onto the core produces frictional contact but this is too late to produce any wrinkles or wrinkles of any significance.

The design of the forming dies and total apparatus is dependent upon the type and diameter of cable core which it is required to wrap. Cable cores as small as 0.25 inches diameter and as large as 1.25 inches diameter have so far, been wrapped successfully upon apparatus according to this invention. The degree of overlap can be varied and depends of course on core diameter and width of wrapping material. The forming dies must be designed to suit the particular requirements as must the spacing between the dies. The degree of overlap of wrapping material is easier to provide on large diameter cable core, but even on small diameter core, well over 210° of arc of overlap taken from the cable core centre has been achieved by the inventive process without wrinkling of the wrapping material.

In general it has been found that the die bore sizes are such that the first die may provide from 0.75 to 0.12 inches diametrical clearance for cable core and the last forming die may provide from around 0.050" to 0.25" diametrical clearance for the cable core. The closing die is generally around the same size as the last forming die. These measurements are, of course, open to choice dependent upon specific requirements.

The inventive process has been used to wrap cable at speeds up to 350 feet/minute and greater speeds should be attainable.

The process is not dependent upon having die orifices of decreasing diameter or cross-sectional area as described in the first embodiment, but is dependent upon maintaining a fixed distance from the core of the part of the wrapping material from where the curling starts and the lack of contact between overlapped and overlapping portions of material, lack of frictional contact being maintained until near completion of the process. Thus, it is possible with certain designs of cable and wrapping material to use only one forming die before the closing die. Alternatively, two or more forming dies of exactly the same design and size may be disposed in series to hold the wrapping material in a specific curled position for an extended period to stabilize it before it moves through the closing die. These dies would have the same diameter orifice.

Figure 8:
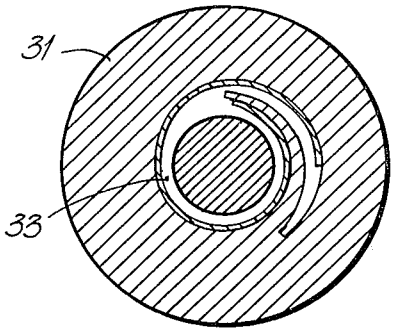
FIGS. 7 and 8 are views similar to FIGS. 2 and 4 of a second embodiment.
Figure 7:
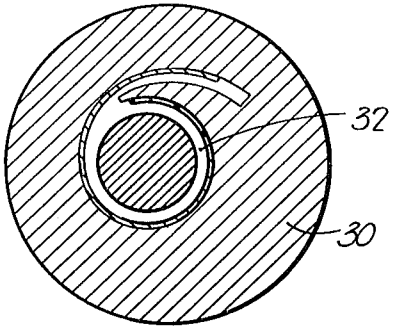

In a second embodiment having dies with equal diameter orifices, apparatus for wrapping cable core is as shown in side elevational in FIG. 1. The dies 1, 2 and 3 are replaced however, by dies with orifices of equal diameter. FIGS. 7 and 8 show dies 30 and 31 which replace, respectively, dies 1 and 3 with a further die to replace die 2 not shown in a similar view. It should be understood however, that the further die has a die orifice with an arcuate extension positioned between those of dies 30 and 31.

As shown in FIGS. 7 and 8 the die orifices 32, 33 of dies 30 and 31 are of equal diameter. Thus in operation, the wrapping material is immediately curled from roller 9 almost to its innermost curled position by orifice 32 and maintains that position through orifice 33. The difference between dies 30 and 31 occurs in the angle of location of their respective arcuate die orifice extensions 34 and 35 which curl the overlapping portion 36 of the wrapping material 6 progressively closer to the overlapped portion 37 in readiness for the material 6 and core 5 to pass through the closing die 4.

What is claimed is:

1. A method of wrapping an article of indefinite length comprising:

feeding the article along a feed path and disposing a wrapping material beneath the article while moving it along a feedpath with a part of the material directly beneath the article disposed substantially parallel to a facing part of the article and while substantially preventing frictional contact between material and article, and (a) while moving the article and material along their feed paths and maintaining said part of the wrapping material parallel to the facing part of the article;

(i) wrapping the material around the article progressively along the article by raising the edges of the material around the article and passing one edge over the other to produce one portion of material overlapping another while holding the overlapping and overlapped portions spaced-apart;

(ii) maintaining the overlapping and overlapped portions spaced-apart as the material is drawn more closely around the article and said portions increase in degree of overlap; and (iii) allowing said portions finally to come into mutual contact; and (b) applying a binding material around the wrapping material to secure the wrapping material to the article progressively along the length of the article, the binding material causing the wrapping material to tightly surround the article by relative movement of the overlapping and overlapped portions further into overlapping engagement.

2. A method of wrapping a powder filled multiconductor electric cable core of indefinite length comprising feeding the core along a feed path and disposing a wrapping material beneath the core while moving it along a feedpath with a part of the material directly beneath the core disposed substantially parallel to a facing part of the core and while substantially preventing frictional contact between material and core, and:

(a) while moving the core and material along their feed paths and maintaining said part of the wrapping material parallel to the facing part of the core;

(i) wrapping the material around the core, progressively along the core by raising the edges of the material around the core and passing one edge over the other to produce one portion of material overlapping another while holding the overlapping and overlapped portions spaced-apart;

(ii) maintaining the overlapping and overlapped portions spaced-apart as the material is drawn more closely around the core and said portions increase in degree of overlap and (iii) allowing said portions finally to come into mutual contact; and (b) applying a binding material around the wrapping material to secure the wrapping material to the core progressively along the length of the core, the binding material causing the wrapping material to tightly surround the core by relative movement of the overlapping and overlapped portions further into overlapping engagement.

3. Apparatus for wrapping an article of indefinite length with a wrapping material comprising positioning means for positioning the elongate article and the wrapping material on feedpaths, said means having a material support surface in one position along the feedpaths to dispose the material on its feedpath beneath the article, means for moving the article and material together along their paths, and at least one forming die for wrapping the material around the article, the forming die having a forming die orifice for passage therethrough of the article and wrapping material, the die having an arcuate tongue extending angularly partly around the orifice and having a free end to define the arcuate die orifice extension radially outwardly of the tongue, the extension being interconnected to the die orifice adjacent the tongue, the forming die disposed along the feedpaths downstream of said one position for passage of the article and wrapping material through the die orifice and for passage of a longitudinally extending portion of the material through the die orifice extension, the forming die having an inner peripheral surface defining the die orifice and being disposed with the lowermost circumferential point of the inner peripheral surface at a distance from the feedpath of the article substantially equal to the distance of the material support surface from the article feedpath.

4. Apparatus according to claim 3 wherein there are at least two forming dies in spaced positions along the feed path, the two dies having inner peripheral surfaces defining die orifices and the dies being relatively disposed to locate the lowermost circumferential point of the inner peripheral surfaces substantially equal distances from the feed path of the article.

5. Apparatus according to claim 4 wherein the dies are formed with die orifices of substantially equal sizes and of similar shapes with the die orifice extension of a downstream die lying in a position closer to the associated die orifice than in the other die.

6. Apparatus according to claim 4 wherein the dies are formed with die orifices which are smaller from one die to another downstream along the feed paths.

* * * * *